US008721464B2

(12) United States Patent
Ou Yang et al.

(10) Patent No.: US 8,721,464 B2
(45) Date of Patent: May 13, 2014

(54) BIAXIAL SUSPENSION TYPE DYNAMIC SIMULATOR

(75) Inventors: Chih-Hung Ou Yang, Kaohsiung (TW); Deng-Horng Lai, Kaohsiung (TW); Ke-Cheng Chien, Kaohsiung (TW)

(73) Assignee: Brogent Technologies Inc., Kaohsiung (TW)

( * ) Notice: Subject to any disclaimer, the term of this patent is extended or adjusted under 35 U.S.C. 154(b) by 199 days.

(21) Appl. No.: 13/364,984

(22) Filed: Feb. 2, 2012

(65) Prior Publication Data

US 2013/0203512 A1 Aug. 8, 2013

(51) Int. Cl.
*A63G 31/16* (2006.01)
*G09B 9/00* (2006.01)

(52) U.S. Cl.
USPC ..... 472/59; 472/130; 434/55

(58) Field of Classification Search
CPC ..... A63G 7/00; A63G 31/00; A63G 31/16; G09B 9/00; G09B 9/04; G09B 9/05; G09B 9/08; G09B 9/12; A63B 21/225; A63B 24/0087; A63B 69/0093
USPC ..... 472/59, 60, 61, 130; 434/29, 55
See application file for complete search history.

(56) References Cited

U.S. PATENT DOCUMENTS

| | | | | |
|---|---|---|---|---|
| 3,619,911 | A * | 11/1971 | Pancoe | 434/58 |
| 4,019,261 | A | 4/1977 | Pancoe | |
| 6,077,078 | A * | 6/2000 | Alet et al. | 434/55 |
| 8,444,496 | B2 * | 5/2013 | Lai et al. | 472/59 |
| 2003/0224333 | A1 * | 12/2003 | Vastvedt | 434/29 |
| 2010/0184524 | A1 | 7/2010 | Lai et al. | |

FOREIGN PATENT DOCUMENTS

| | | | |
|---|---|---|---|
| KR | 20110030097 | A | 3/2011 |
| WO | WO03/046862 | A1 | 6/2003 |

OTHER PUBLICATIONS

ERC search report issued Sep. 7, 2012.

* cited by examiner

*Primary Examiner* — Kien Nguyen
(74) *Attorney, Agent, or Firm* — Chun-Ming Shih; HDLS IPR Services

(57) ABSTRACT

A dynamic simulator includes a carrying platform, a movable platform, a load carrying seat, a first actuator pivotally coupled to carrying platform, and a second actuator pivotally coupled to movable platform, and an included angle is formed between the first actuator and the carrying platform, and an included angle is formed between the second actuator and the load carrying seat, and an included angle is formed between the second actuator and the first actuator, so as to simplify the dynamic simulator.

15 Claims, 7 Drawing Sheets

BIAXIAL SUSPENSION TYPE DYNAMIC SIMULATOR

FIELD OF THE INVENTION

The present invention relates to a dynamic simulator, in particular to a suspension type dynamic simulator applied in recreational facilities.

BACKGROUND OF THE INVENTION

In conventional dynamic simulators used for recreational facilities, a big screen is generally installed in front of a screening room, and an audience sits on the dynamic simulator at the back of the screening room. The dynamic simulator includes a platform, a driving device and a plurality of seats, wherein the driving device is installed under the platform and the seats provided for the audience to sit are installed on the platform, and the driving device is controlled according to the content of a movie, so that the platform and the seats installed on the platform can be moved freely in different directions including forward, backward, upward and downward directions, or elevated, tilted, turned, or spun, so that the audience can have an immersive experience and feel like they are in the movie scenes.

Traditionally, the dynamic simulator is applied in a Stewart platform comprising six sets of linear actuators, a plurality of universal joints, a platform and a base coupled to one another, and the six sets of linear actuators can be extended, contracted and dragged with one another to drive the platform and the seats to produce positional and angular changes, so as to provide the immersive experience of the movie scenes to the audience in the seats. However, the Stewart platform comes with six sets of linear actuators, not only involving lots of components, a complicated installation, and a high price, but also incurring a high maintenance and repair cost, and thus such dynamic simulator fails to meet user requirements.

In view of the foregoing problems, the inventor of the present invention conducted extensive researches and experiments, and finally provided a feasible design to overcome the problems.

SUMMARY OF THE INVENTION

Therefore, it is a primary objective of the present invention to provide a biaxial suspension type dynamic simulator to simplify the dynamic simulator and provide an immersive experience of the movie scene to the audience.

To achieve the aforementioned objective, the present invention provides a biaxial suspension type dynamic simulator, comprising: a carrying platform; a movable platform, coupled to the bottom of the carrying platform; a load carrying seat, suspended below the movable platform, and having a load carrying space formed at a front side of the load carrying seat and provided for a passenger to sit therein; at least one first actuator, each including a first driver and a first telescopic rod with an end driven by the first driver, and the first driver being pivotally coupled to the carrying platform, and the other end of the first telescopic rod being pivotally coupled to the movable platform, and the first telescopic rod being extended/contracted in a first extending/contracting direction, and an included angle being formed between the first extending/contracting direction and the carrying platform; and a second actuator, including a second driver and a second telescopic rod with an end driven by the second driver, and the second driver being pivotally coupled to the movable platform, and the other end of the second telescopic rod being pivotally coupled to the load carrying seat, and the second telescopic rod being extended/contracted in a second extending/contracting direction, and an included angle being formed between the second extending/contracting direction and the load carrying seat and the first extending/contracting direction.

In the biaxial suspension type dynamic simulator of the present invention, the first and second actuators are arranged obliquely with an included angle formed between the first and second actuators, and an end of the first actuator is pivotally coupled to the carrying platform, and the other end of the first actuator is pivotally coupled to the movable platform. In addition, an end of the second actuator is pivotally coupled to the movable platform, and the other end is pivotally coupled to the load carrying seat, so that the interaction of the first actuator and second actuators drives the load carrying seat to move freely in different directions including forward, backward, upward and downward, or elevated, tilted, turned, or spun. Compared with the conventional dynamic simulator installed on a Stewart platform, the biaxial suspension type dynamic simulator of the present invention comes with a simpler structure, a lower installation cost, and easier maintenance and repair. The audience can have an immersive experience of the movie scenes while watching a movie, and thus the present invention improves over the conventional dynamic simulators.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 1:
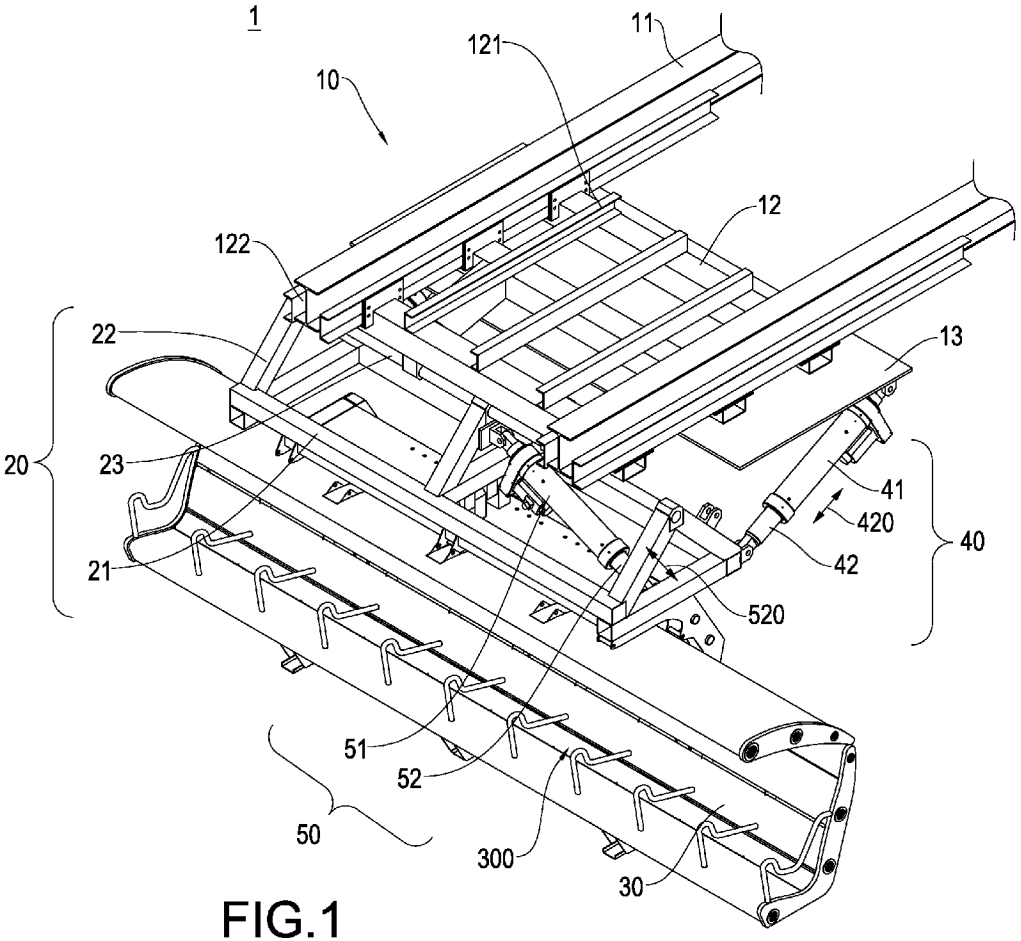
FIG. 1 is a perspective view of a biaxial suspension type dynamic simulator of the present invention, viewed from a side.
Figure 2:
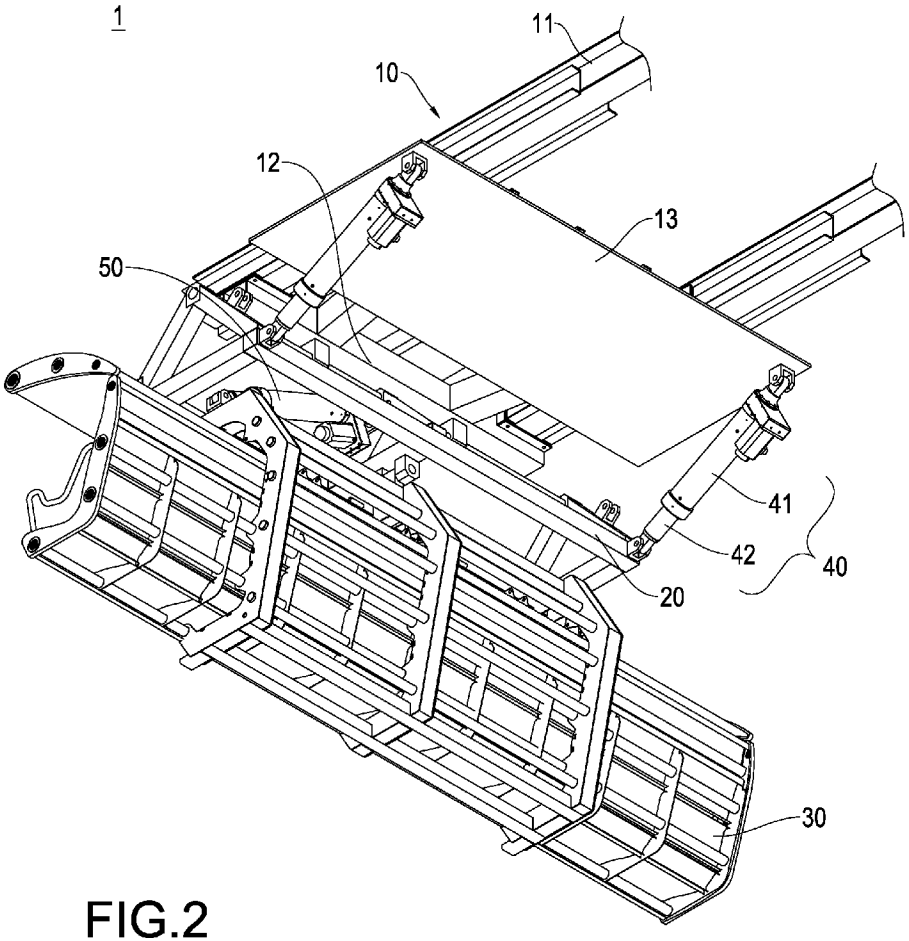
FIG. 2 is a perspective view of a biaxial suspension type dynamic simulator of the present invention, viewed from another side.

With reference to FIGS. 1 and 2 for perspective views of a biaxial suspension type dynamic simulator of the present invention, viewed from two different sides respectively, the biaxial suspension type dynamic simulator 1 (hereinafter referred to as "dynamic simulator") comprises a carrying platform 10, a movable platform 20, a load carrying seat 30, at least one first actuator 40, and a second actuator 50.

The carrying platform 10 includes a set of rails 11, a support base 12 slidably moved on the rail 11, and a base 13 fixed to the bottom of the support base 12. The support base 12 includes a plurality of criss-cross steel angles 121 perpendicularly installed with each other and above the base 13. In addition, two edges of the support base 12 are corresponsive to the set of rails 11 and have a slide groove 122 each, and the rail 11 is passed through the slide groove 122, so that the support base 12 can slide back and forth on the set of rails 11. Preferably, the base 13 is perpendicular to the set of rails 11 and disposed at an edge of the support base 12, and the movable platform 20 is also perpendicular to the set of rails 11 and disposed at the other opposite edge of the support base 12.

The movable platform 20 is coupled to the bottom of the support base 12 of the carrying platform 10. In this preferred embodiment, the movable platform 20 includes a long frame 21 fixed to the plurality of angle frames 22 on the long frame 21 and provided for serially connecting a rotating rod 23 of the angle frames 22, and the long frame 21 is coupled to the load carrying seat 30, and the rotating rod 23 is coupled to the carrying platform 10. In this preferred embodiment, each of the angle frames 22 is a triangular frame board, and the angle frames 22 are equidistantly installed on the long frame 21, and the second actuator 50 is installed between the angle frames 22.

The load carrying seat 30 is suspended below the movable platform 20, and the load carrying seat 30 has a load carrying space 300 formed at a front side of the load carrying seat 30 and provided for passengers to sit therein.

The first actuator 40 includes a first driver 41 and a first telescopic rod 42 with an end driven by the first driver 41, and the first driver 41 is pivotally coupled to the base 13 of the carrying platform 10, and the other end of the first telescopic rod 42 is pivotally coupled to the long frame 21 of the movable platform 20, and the first telescopic rod 42 can be extended/contracted in a first extending/contracting direction 420, and an included angle is formed between the first extending/contracting direction 420 and the carrying platform 10, and the first extending/contracting direction 420 is a direction of extending/contracting from the carrying platform 10 towards the load carrying seat 30. Preferably, the dynamic simulator 1 comprises a pair of first actuators 40 symmetrically installed at two edges of the carrying platform 10.

The second actuator 50 includes a second driver 51 and a second telescopic rod 52 with an driven by the second driver 51, and the second driver 51 is pivotally coupled to the angle frame 22 of the movable platform 20, and the other end of the second telescopic rod 52 is pivotally coupled to the load carrying seat 30, and the second telescopic rod 52 can be extended/contracted in a second extending/contracting direction 520, wherein an included angle is formed between the second extending/contracting direction 520 and the load carrying seat 30 and an included angle is formed between the second extending/contracting direction 520 and the first extending/contracting direction 420, and the second extending/contracting direction 520 is a direction of extending/contracting from the movable platform 20 towards the load carrying seat 30. In this preferred embodiment, the first actuator 40 and the second actuator 50 are linear actuators.

Figure 3:
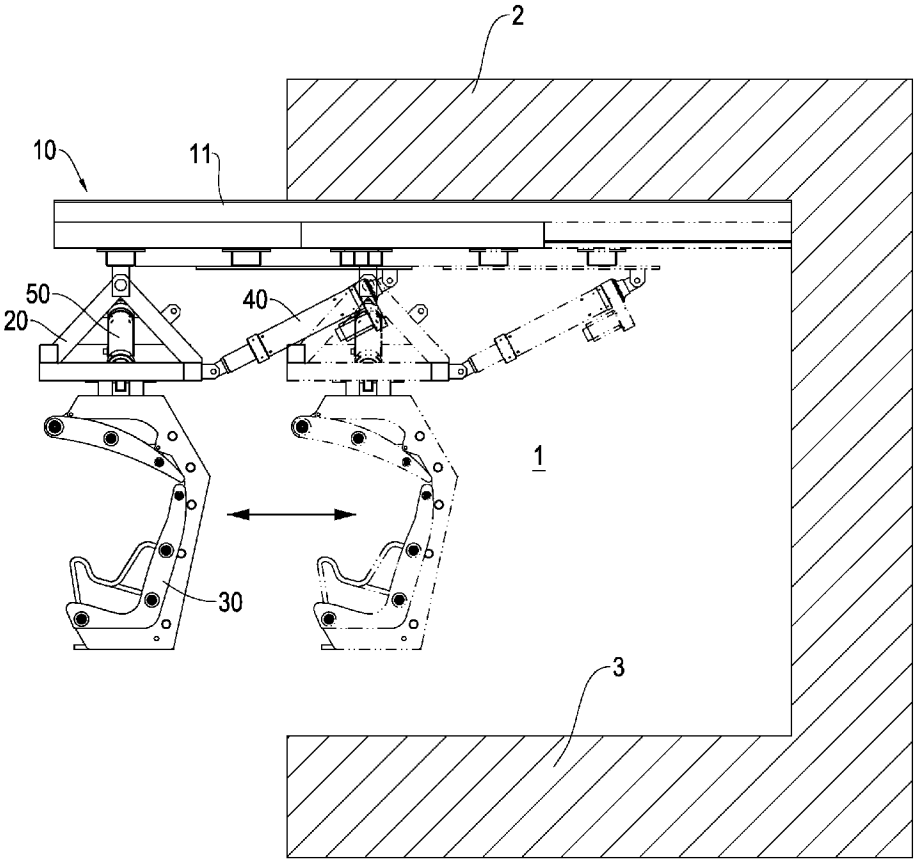
FIG. 3 is a schematic view of using a biaxial suspension type dynamic simulator of the present invention.

With reference to FIG. 3 for a schematic view of using a biaxial suspension type dynamic simulator of the present invention, the dynamic simulator 1 is a suspension type dynamic simulator having the rail 11 fixed to a ceiling 2, and the support base 12 is slidably installed on the rail 11 for a horizontal movement. When the support base 12 is situated at the back, the load carrying seat 30 is situated at a position opposite to the top of a fixing surface 3 to facilitate the passenger to sit. When the dynamic simulator 1 starts its operation, the support base 12 is moved horizontally forward to push the load carrying seat 30 to the outside of the fixing surface 3, so as to enhance the immersive experience of the movie scenes.

Figure 4:
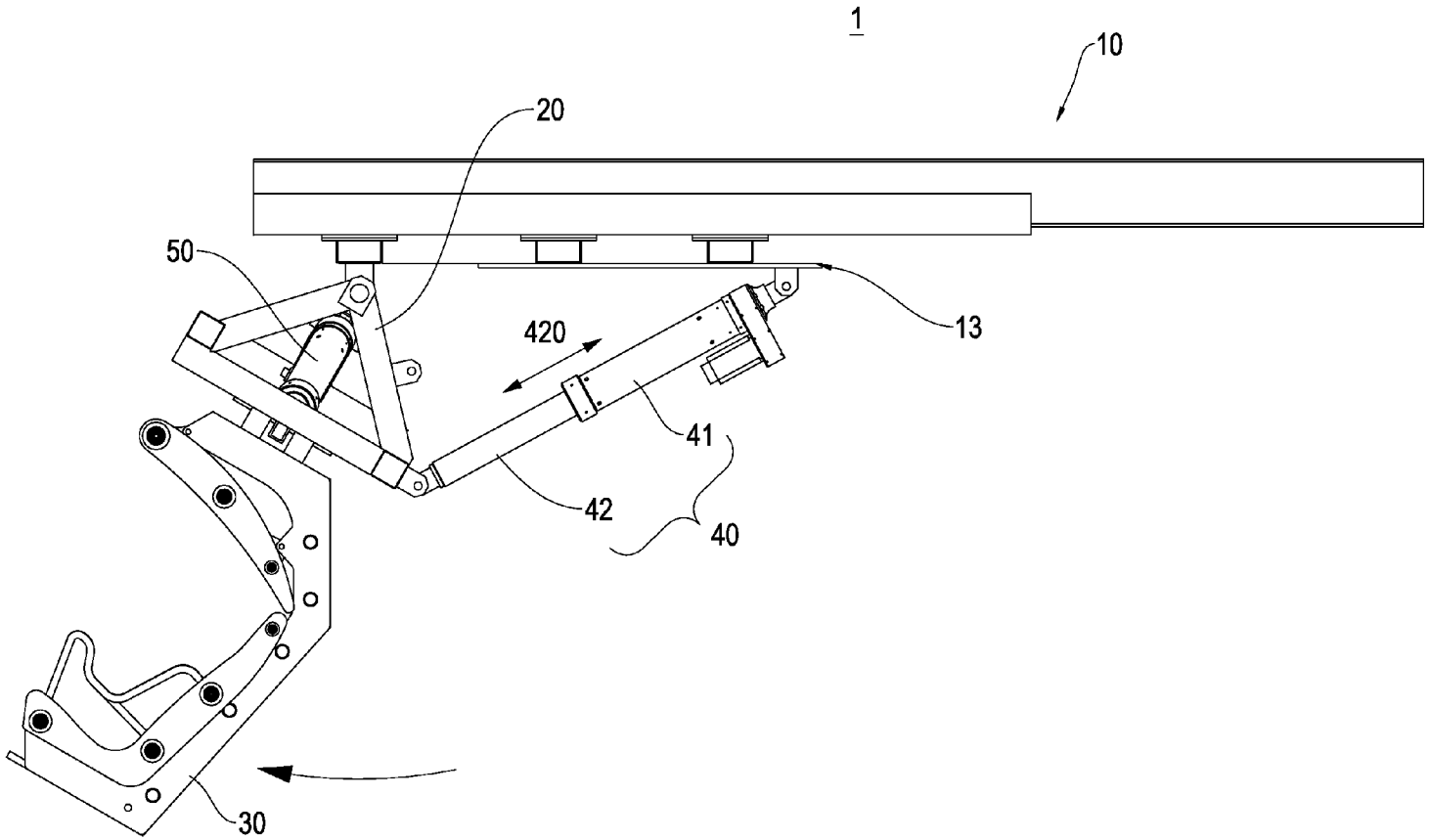
FIG. 4 is a first schematic view of movements of a first actuator of a biaxial suspension type dynamic simulator of the present invention.
Figure 5:
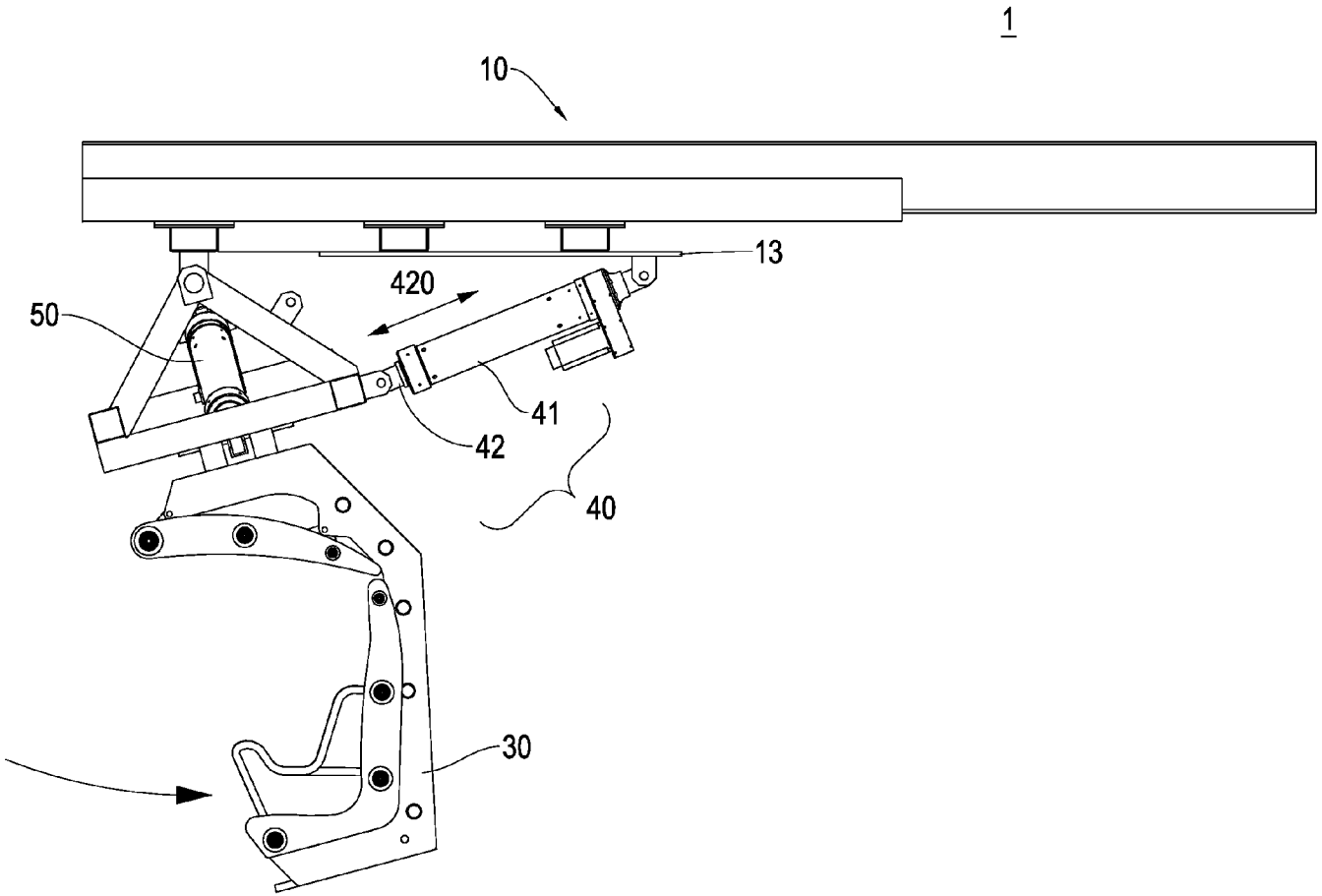
FIG. 5 is a second schematic view of movements of a first actuator of a biaxial suspension type dynamic simulator of the present invention.

With reference to FIGS. 4 and 5 for the schematic views of movements of a first actuator of a biaxial suspension type dynamic simulator in accordance with the present invention respectively, when the first actuator 40 is operated, the first telescopic rod 42 can be extended to drive the movable platform 20 to move outwardly in the first extending/contracting direction 420. When the first telescopic rod 42 is contracted, the first telescopic rod 42 pulls the movable platform 20 back. Now, the reaction produced by the movable platform 20 rotates the first driver 41 with respect to the carrying platform 10, so that the reciprocal movements of the first telescopic rod 42 can move and rotate the movable platform 20 together with the load carrying seat 30.

Figure 6:
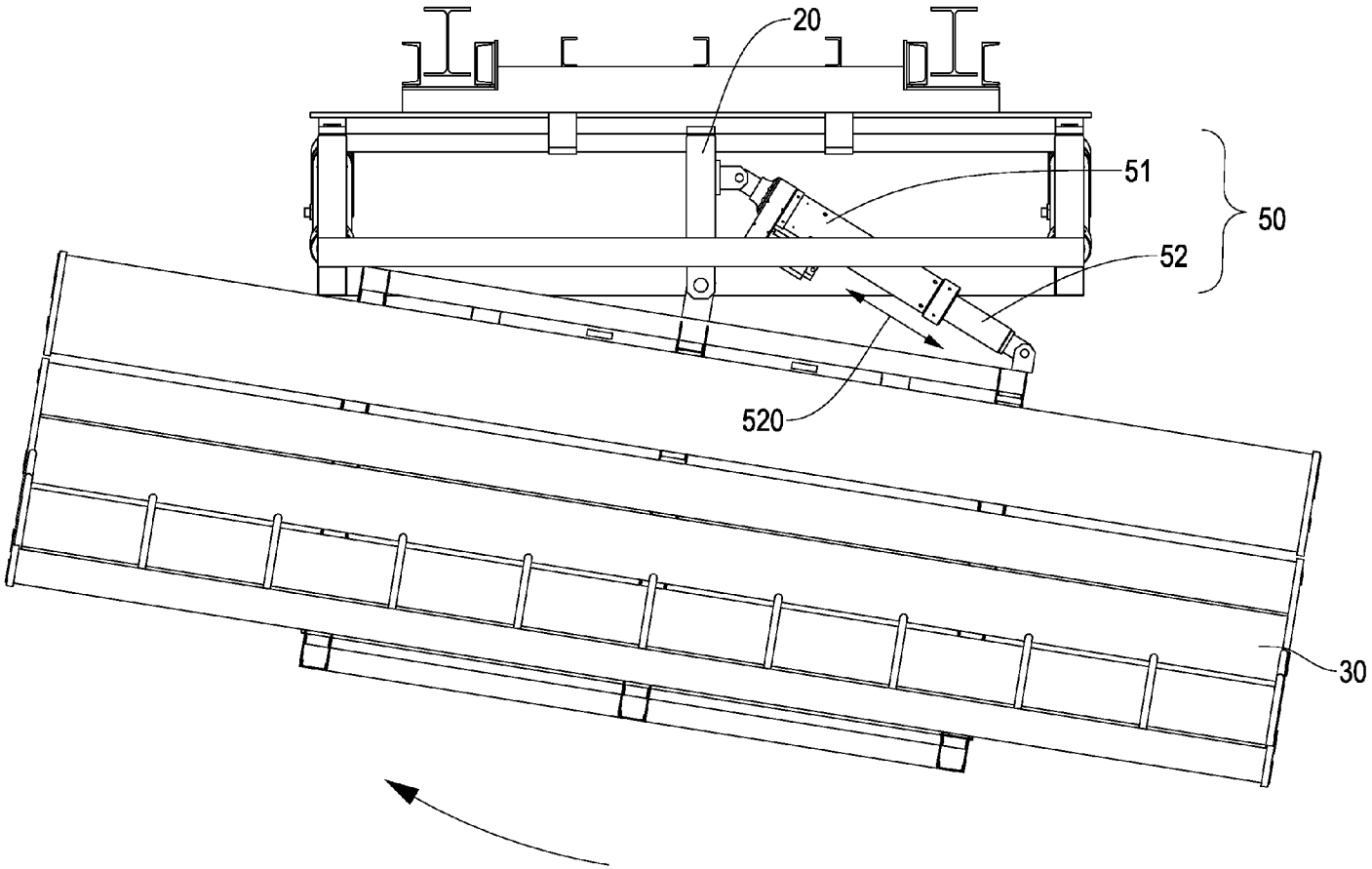
FIG. 6 is a first schematic view of movements of a second actuator of a biaxial suspension type dynamic simulator of the present invention.
Figure 7:
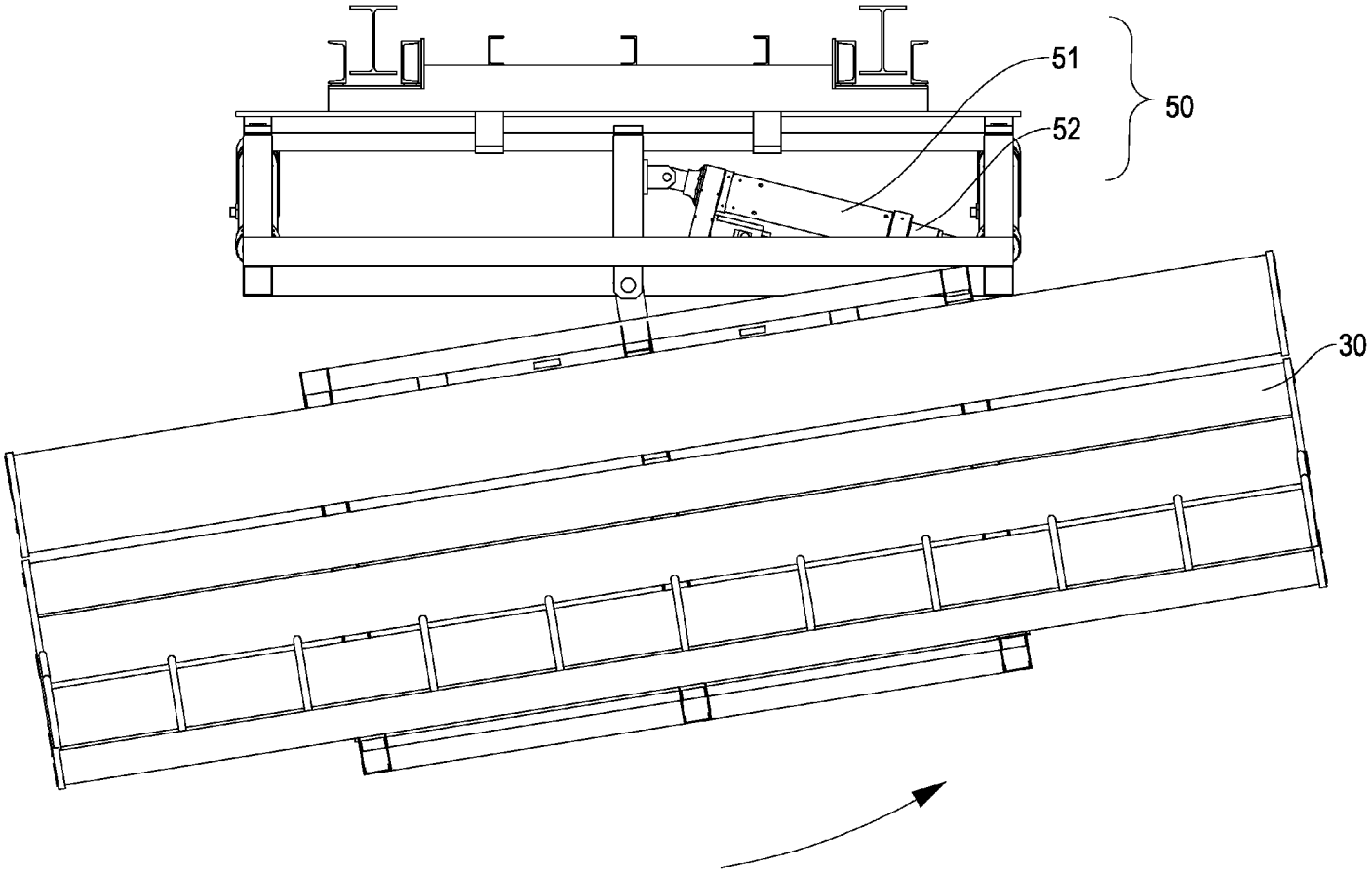
FIG. 7 is a second schematic view of movements of a second actuator of a biaxial suspension type dynamic simulator of the present invention.

With reference to FIGS. 6 and 7 for the schematic views of movements of a second actuator of a biaxial suspension type dynamic simulator in accordance with the present invention respectively, when the second actuator 50 is operated, the second telescopic rod 52 can be extended to drive the load carrying seat 30 to move outwardly in the second extending/contracting direction 520. When the second telescopic rod 52 is contracted, the second telescopic rod 42 pulls the load carrying seat 30 back, and the reaction produced by the load carrying seat 30 drives the second driver 51 to rotate with respect to the movable platform 20 while driving the load carrying seat 30 to move and rotate. Therefore, the reciprocal movements of the second telescopic rod 52 can move and rotate the load carrying seat 30 with respect to the movable platform 20.

With the interaction of the first actuator 40 and the second actuator 50, the load carrying seat 30 can be rolled to the left or right and elevated or tilted to the front or back, so that the audience can have an immersive experience of the movie scenes while watching a movie.

While the invention has been described by means of specific embodiments, numerous modifications and variations could be made thereto by those skilled in the art without departing from the scope and spirit of the invention set forth in the claims.

What is claimed is:

1. A biaxial suspension type dynamic simulator, comprising:

a carrying platform;

a movable platform, coupled to the bottom of the carrying platform;

a load carrying seat, suspended below the movable platform, and having a load carrying space formed at a front side of the load carrying seat and provided for a passenger to sit therein;

at least one first actuator, each including a first driver and a first telescopic rod with an end driven by the first driver, and the first driver being pivotally coupled to the carrying platform, and the other end of the first telescopic rod being pivotally coupled to the movable platform, and the first telescopic rod being extended/contracted in a first extending/contracting direction, and an included angle being formed between the first extending/contracting direction and the carrying platform; and a second actuator, including a second driver and a second telescopic rod with an end driven by the second driver, and the second driver being pivotally coupled to the movable platform, and the other end of the second telescopic rod being pivotally coupled to the load carrying seat, and the second telescopic rod being extended/contracted in a second extending/contracting direction, and an included angle being formed between the second extending/contracting direction and the load carrying seat and the first extending/contracting direction, wherein the carrying platform includes a set of rails, a support base slidably moved on the rail, and a base fixed to the bottom of the support base.

2. The biaxial suspension type dynamic simulator of claim 1, wherein the support base has two edges corresponding to the set of rails and having a slide groove each, and the rail is passed through the corresponding slide groove.

3. The biaxial suspension type dynamic simulator of claim 1, wherein the base is perpendicular to the set of rails and disposed on an edge of the support base, and the movable platform is perpendicular to the set of rails and disposed on the other edge opposite to the support base.

4. The biaxial suspension type dynamic simulator of claim 3, wherein the first driver is pivotally coupled to the base.

5. The biaxial suspension type dynamic simulator of claim 1, wherein the support base includes a plurality of criss-cross steel angles perpendicularly installed with each other and above the base.

6. The biaxial suspension type dynamic simulator of claim 1, further comprising a pair of first actuators symmetrically installed on both sides of the carrying platform respectively.

7. The biaxial suspension type dynamic simulator of claim 1, wherein the first actuator and the second actuator is a linear actuator.

8. The biaxial suspension type dynamic simulator of claim 7, wherein the first extending/contracting direction is a direction of extending/contracting from the carrying platform towards the load carrying seat.

9. The biaxial suspension type dynamic simulator of claim 7, wherein the second extending/contracting direction is a direction of extending/contracting from the movable platform towards the load carrying seat.

10. A biaxial suspension type dynamic simulator, comprising:

a carrying platform;

a movable platform, coupled to the bottom of the carrying platform;

a load carrying seat, suspended below the movable platform, and having a load carrying space formed at a front side of the load carrying seat and provided for a passenger to sit therein;

at least one first actuator, each including a first driver and a first telescopic rod with an end driven by the first driver, and the first driver being pivotally coupled to the carrying platform, and the other end of the first telescopic rod being pivotally coupled to the movable platform, and the first telescopic rod being extended/contracted in a first extending/contracting direction, and an included angle being formed between the first extending/contracting direction and the carrying platform; and a second actuator, including a second driver and a second telescopic rod with an end driven by the second driver, and the second driver being pivotally coupled to the movable platform, and the other end of the second telescopic rod being pivotally coupled to the load carrying seat, and the second telescopic rod being extended/contracted in a second extending/contracting direction, and an included angle being formed between the second extending/contracting direction and the load carrying seat and the first extending/contracting direction, wherein the movable platform includes a long frame fixed onto a plurality of angle frames on the long frame and provided for serially connecting a rotating rod of the angle frames, and the long frame is coupled to the load carrying seat, and the rotating rod is coupled to the carrying platform.

11. The biaxial suspension type dynamic simulator of claim 10, wherein the angle frames are equidistantly installed on the long frame.

12. The biaxial suspension type dynamic simulator of claim 11, wherein the second actuator is installed between the angle frames and pivotally coupled to the angle frames.

13. The biaxial suspension type dynamic simulator of claim 11, wherein each of the angle frames is a triangular frame board.

14. The biaxial suspension type dynamic simulator of claim 10, wherein the first telescopic rod has another end pivotally coupled to the long frame.

15. The biaxial suspension type dynamic simulator of claim 10, wherein each of the angle frames is a triangular frame board.

* * * * *